US011719500B2

(12) United States Patent
Descatoire

(10) Patent No.: US 11,719,500 B2
(45) Date of Patent: Aug. 8, 2023

(54) AMMUNITION LAUNCHING DEVICE

(71) Applicant: NEXTER SYSTEMS, Versailles (FR)

(72) Inventor: Xavier Descatoire, Bourges (FR)

(73) Assignee: NEXTER SYSTEMS, Versailles (FR)

( * ) Notice: Subject to any disclaimer, the term of this patent is extended or adjusted under 35 U.S.C. 154(b) by 0 days.

(21) Appl. No.: 17/787,642

(22) PCT Filed: Dec. 15, 2020

(86) PCT No.: PCT/IB2020/061934
§ 371 (c)(1),
(2) Date: Jun. 21, 2022

(87) PCT Pub. No.: WO2021/130605
PCT Pub. Date: Jul. 1, 2021

(65) Prior Publication Data

US 2022/0412683 A1 Dec. 29, 2022

(30) Foreign Application Priority Data

Dec. 24, 2019 (FR) ..... 1915281

(51) Int. Cl.
*F41A 21/06* (2006.01)
*F41A 27/02* (2006.01)
*F41A 27/24* (2006.01)

(52) U.S. Cl.
CPC ..... *F41A 21/06* (2013.01); *F41A 27/02* (2013.01); *F41A 27/24* (2013.01)

(58) Field of Classification Search
CPC ..... F41A 21/06; F41A 27/02; F41A 27/22; F41A 27/24
(Continued)

(56) References Cited

U.S. PATENT DOCUMENTS 2,826,960 A * 3/1958 Schiavi ..... F41A 23/42 89/40.01
3,865,009 A * 2/1975 Kongelbeck ..... F41F 3/04 89/1.819
(Continued)

FOREIGN PATENT DOCUMENTS

EP 1 816 427 A1 8/2007
EP 1 930 685 A1 6/2008
(Continued)

OTHER PUBLICATIONS

Apr. 8, 2021 International Search Report issued in International Patent Application No. PCT/IB2020/061934.
(Continued)

*Primary Examiner* — Bret Hayes
(74) *Attorney, Agent, or Firm* — Oliff PLC

(57) ABSTRACT

A launching device comprising at least two tubes intended to receive an ammunition round and each secured to a mount, the mounts being carried by a base, each tube being orientable in elevation and in bearing by motors, a first motor ensuring the pointing in bearing of the two tubes simultaneously and a second motor ensuring the pointing in elevation of the two tubes simultaneously. The bearing pointing axes of the two tubes are parallel to each other and each mount includes a sleeve carrying the tube, the sleeve of each mount being mounted so as to pivot in elevation relative to a fork, the fork being itself mounted so as to pivot in bearing relative to the base.

12 Claims, 5 Drawing Sheets

(58) Field of Classification Search
USPC ..... 89/40.04, 41.02, 41.04, 41.15
See application file for complete search history.

(56) References Cited

U.S. PATENT DOCUMENTS

| | | | | | |
|---|---|---|---|---|---|
| 4,305,325 | A * | 12/1981 | Lange | F41A 27/24 | 89/1.816 |
| 4,441,401 | A * | 4/1984 | Hobson | F41A 27/24 | 89/36.13 |
| 4,523,487 | A * | 6/1985 | Pietzsch | F41A 23/56 | 89/37.17 |
| 5,403,243 | A * | 4/1995 | Behrens | F16H 1/28 | 89/1.816 |
| 9,746,270 | B1 * | 8/2017 | Rose | F41A 27/20 | |

FOREIGN PATENT DOCUMENTS

| | | |
|---|---|---|
| EP | 2 157 398 A2 | 2/2010 |
| FR | 2 611 259 A1 | 8/1988 |
| FR | 2 704 050 A1 | 10/1994 |

OTHER PUBLICATIONS

Apr. 8, 2021 Written Opinion issued in International Patent Application No. PCT/IB2020/061934.
Sep. 8, 2020 Preliminary Search Report issued in French Patent Application No. FR1915281.
Sep. 8, 2020 Written Opinion issued in French Patent Application No. FR1915281.

* cited by examiner

AMMUNITION LAUNCHING DEVICE

The technical field of the invention is that of launching devices including at least two tubes intended to receive an ammunition round.

These launching devices are well known in the field of close-range defense of vehicles or fixed platforms.

They allow the firing of close-range defense ammunition, for example smoke ammunition, ammunition generating light flashes and noise, or ammunition generating fragments.

One of the current difficulties lies in the integration of such launching devices on a given platform. In most cases, this integration has to be planned very early in the design of the platform (for example, a land vehicle) in order to allow for the creation of areas that can accommodate the launching devices.

Launching devices are known which have fixed orientations of their firing axes relative to the platform.

These devices present the disadvantage of only providing protection along sectors that are predefined and limited in dimension.

The protection of the vehicle can then be improved only by multiplying the number of launching devices, which is expensive and multiplies the problems of integration.

Furthermore, attempts have been made to define launching devices with a pointing capacity (in elevation or in bearing), thus allowing them to adapt their firing to the location of a given threat.

For example, patent EP1930685 proposes a small turret that includes several tubes and allows aiming in elevation and in bearing.

This device is very cumbersome and can only be positioned in the superstructure, where the main weapon systems of the vehicle are already located, such as the small-caliber, medium-caliber or large-caliber turrets and also the sighting and observation means.

It does not meet the need for a device dedicated to the close-range protection of the platform and which should be small and inexpensive.

It is also known from patent US2001/0015126 multi-tube devices in which the elevation pointing angles are fixed but it is possible to modify the bearing pointing angles of all the tubes.

A single motorization ensures the corrections of pointing of all the tubes. This device is still cumbersome, and the pointing capabilities are limited.

Patent EP2157398 describes a launching device in which a first motorization ensures the pointing in bearing of all the tubes and a second motorization ensures the pointing in elevation of all the tubes.

This latter device has improved pointing capabilities, but it remains cumbersome and its structure as a vertical column limits it to installation in the vicinity of a rear part of a vehicle, which reduces the protection capacity provided.

It is the purpose of the invention to propose a launching device which is both inexpensive and compact, the configuration of which can be easily modified to allow its integration on all types of platforms and in particular vehicles. The integration can be easily made on any part of the platform, for example for a vehicle in the front area, in the rear area, laterally on a body or even on a turret.

Thus, the invention relates to a launching device including at least two tubes intended to receive an ammunition round and each secured to a mount, the mounts being carried by a base, each tube being orientable in elevation and in bearing by motor means, a first motor means ensuring the pointing in bearing of the two tubes simultaneously and a second motor means ensuring the pointing in elevation of the two tubes simultaneously, the device being characterized in that the bearing pointing axes of the two tubes are parallel to each other and in that each mount includes a sleeve carrying the tube, said sleeve being mounted so as to pivot in elevation relative to a fork, the fork being itself mounted so as to pivot in bearing relative to the base, the second motor means acting on each sleeve by means of a set of two bevel toothed pinions with perpendicular axes integrated into the mount, a first pinion being secured to the sleeve and a second pinion being coaxial with the bearing axis, the first motor means acting on each mount via a first gear wheel secured to the fork, and the second bevel pinion being secured to one end of a pivot shaft carrying at its other end a second gear wheel driven by the second motor means, the pivot shaft being coaxial with the first gear wheel.

According to one particular embodiment, the first motor means may act on the first gear wheels of the mounts in a simultaneous way by a first drive means which comprises a first toothed belt.

According to one particular embodiment, the second motor means can act on the second gear wheels of the mounts in a simultaneous way by a second driving means which comprises a second toothed belt.

Advantageously, at least one emergency control means may be secured to the base and will make it possible to drive one or other of the toothed belts manually.

According to one particular embodiment, the axes of each tube can be offset in bearing by a fixed angle.

According to one embodiment, the axes of pivoting elevation of the two tubes may be parallel, the offset between the axes of the tubes being ensured by at least one wedge interposed between the tube and the sleeve.

In particular, a wedge may be interposed between each tube and its associated sleeve, the offset angle between the tubes resulting from the combination of the inclinations given by each wedge.

Advantageously, the offset angle may be between 10° and 20°.

The invention will be better understood upon reading the following description of particular embodiments, description made with reference to the attached drawings in which.

Figure 9A:
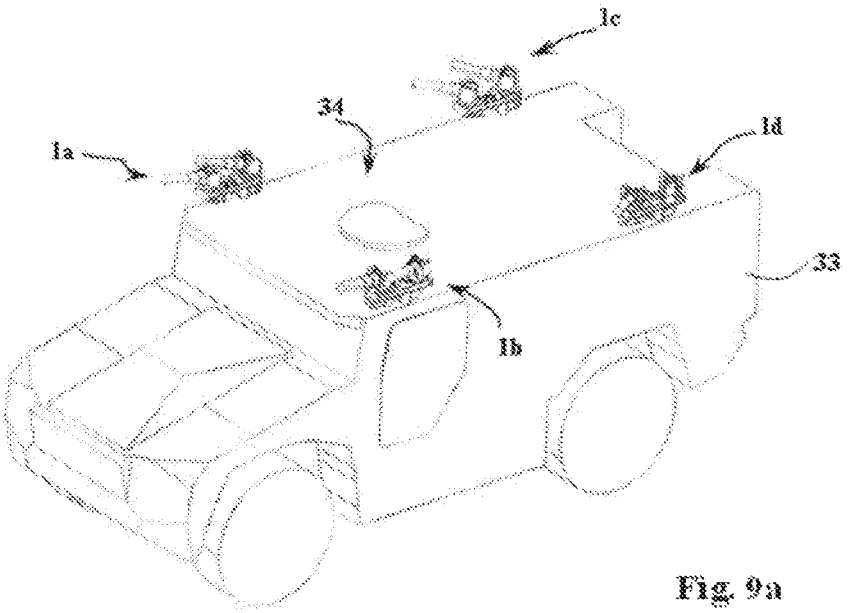
Figure 9B:
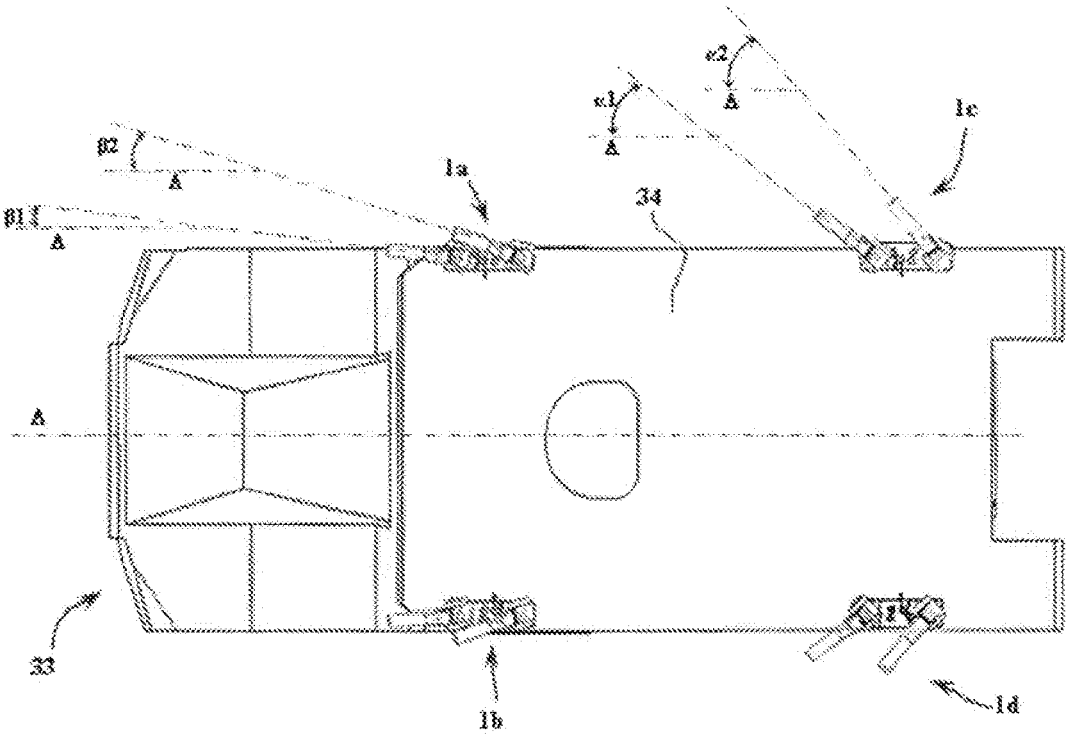

FIG. 9*a* is a front perspective view of an example of integration of the device according to the invention on a vehicle;

FIG. 9*b* is a top view of the vehicle equipped with the device according to the invention.

Figure 1:
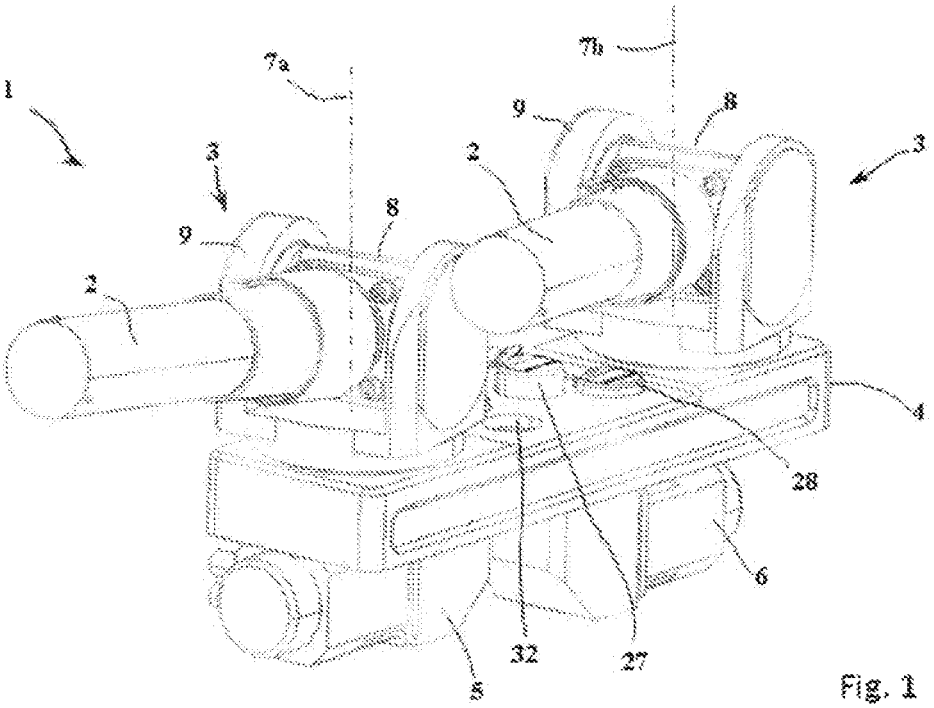
FIG. 1 is a front perspective view of a launching device according to one embodiment of the invention.
Figure 2:
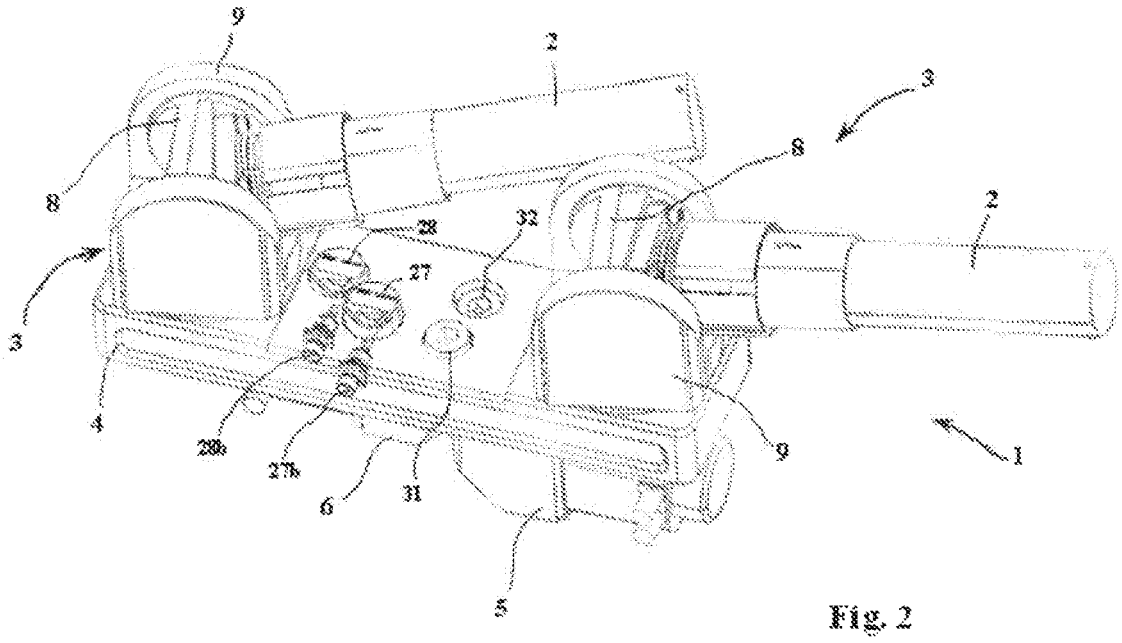
FIG. 2 is an upper perspective view of this launching device.

Referring to FIGS. 1 and 2, a launching device 1 according to one embodiment of the invention, includes two tubes 2 which are intended to receive an ammunition round (not shown), and which are each secured to a mount 3.

The mounts 3 are carried by a base 4 and each tube can be oriented in elevation and in bearing relative to the base 4 by motor means. In a conventional manner, an axis perpendicular to the base 4 and around which the mount rotates will be referred to as bearing pointing axis 7, 7*a* or 7*b* (or bearing axis). An axis parallel to the base 4 (and perpendicular to the bearing axis) and around which the tube will rotate will be referred to as elevation pointing axis 14, 14*a* or 14*b* (or elevation axis).

A first motor means 5 ensures the pointing in bearing of the two tubes in a simultaneous way.

A second motor means 6 ensures the pointing in elevation of the two tubes in a simultaneous way.

The motors 5 and 6 are electric gear motors. The two motors are controlled by an electronic control box (not shown) which gives the desired pointing instructions in elevation and bearing to ensure the protection of a platform carrying the launching device 1.

As can be seen on the figures, the bearing pointing axes 7*a* and 7*b* of the two tubes are parallel to each other.

Furthermore, each mount 3 includes a sleeve 8 carrying the tube 2, the sleeve being mounted so as to pivot in elevation relative to a fork 9. The fork 9 is the part of the mount 3 that is pivotally mounted in bearing relative to the base 4.

Figure 5:
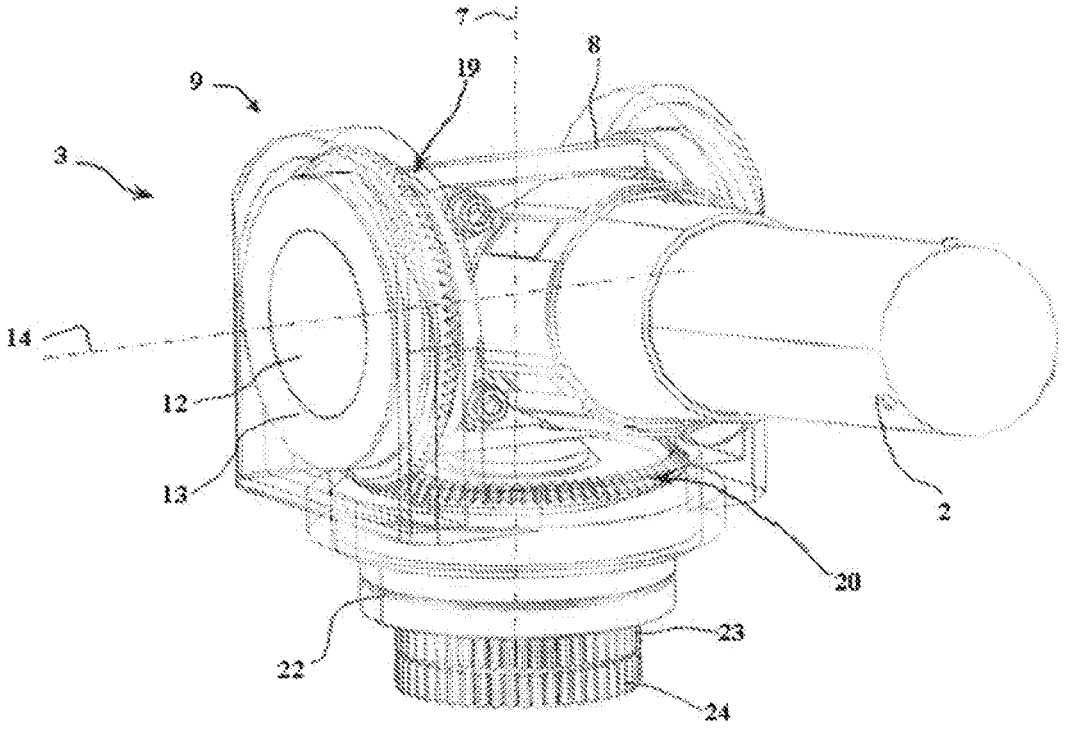
FIG. 5 is a transparent view of a mount, showing the different sets of pinions and gears.
Figure 8:
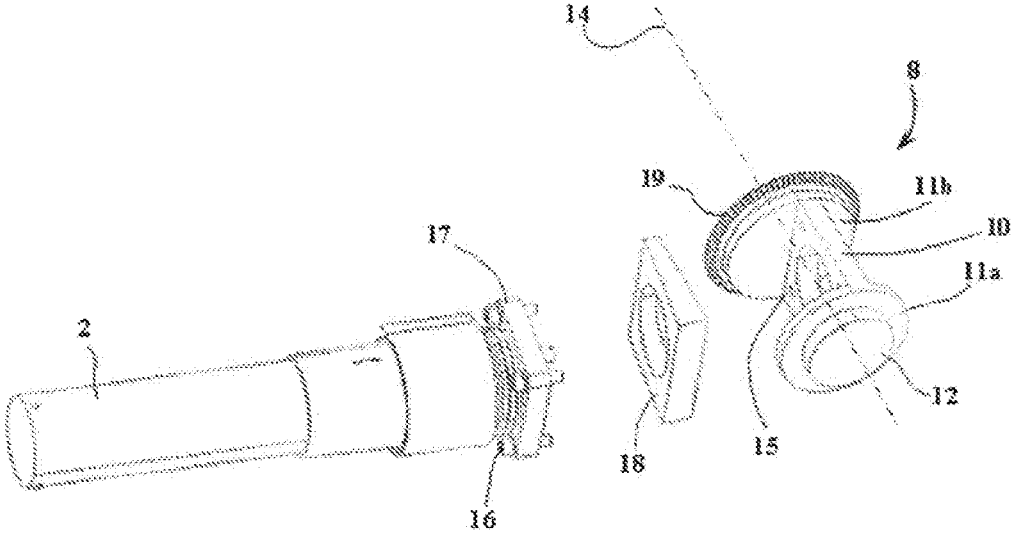
FIG. 8 is an exploded view of the assembly of a tube and a sleeve, showing the wedge.

FIG. 5 shows in more detail the structure of a mount 3. FIG. 8 shows an exploded view of the sleeve 8 and the tube 2.

As seen in FIG. 8, the sleeve 8 includes a middle plate 10 that is connected to side cheeks 11*a* and 11*b*. Each cheek 11*a*, 11*b* includes a central trunnion 12 that fits into a leg of the fork 9. A ball bearing 13 is interposed between each trunnion 12 and the corresponding leg of the fork 9.

The trunnions 12 constitute the elevation pointing axis 14 (or 14*a* or 14*b*) of the mount 3.

As seen in FIG. 8, the middle plate 10 has tapped holes 15 into which screws 16 engage to secure a baseplate 17 of the tube 2 to the sleeve 8.

According to one particular embodiment which will be detailed later, a wedge 18 can be interposed between the baseplate 17 of the tube 2 and the sleeve 8. This wedge 18 will have holes through which the screws 16 can pass.

Figure 6:
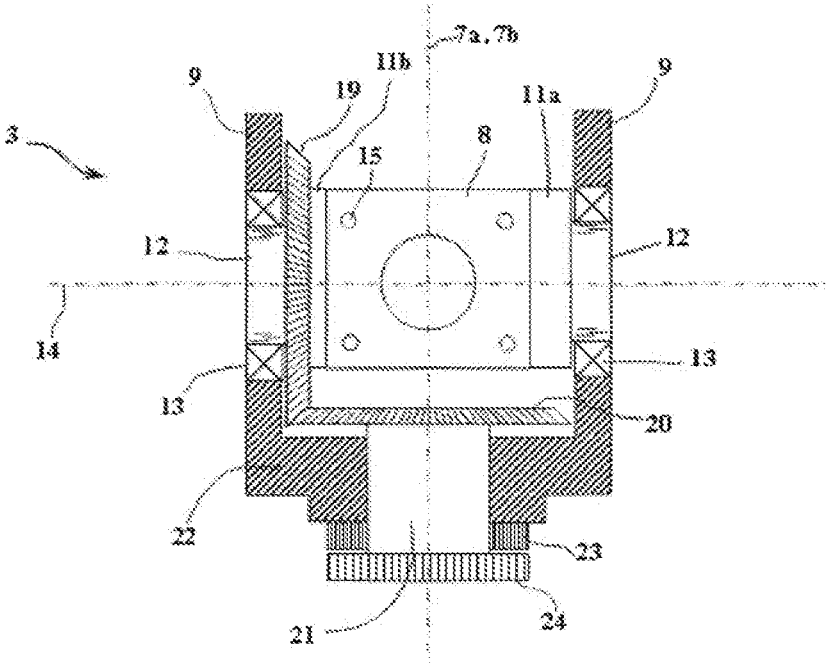
FIG. 6 is a simplified sectional view of a mount.

As can be seen in FIGS. 5, 6 and 8, the sleeve 8 includes a first bevel pinion 19 at one of its side cheeks 11*b*. This first pinion has as its axis the elevation pointing axis 14 (14*a* or 14*b*) and it is meshed with a second pinion 20 which is coaxial with the bearing pointing axis 7 (7*a* or 7*b*).

The axes of the two bevel pinions 19 and 20 are therefore perpendicular.

The fork 9 includes a mounting plate 22 which connects its two legs. This mounting plate 22 is pivotally mounted on the base 4 by means of a cylindrical face or a bearing.

The mounting plate 22 also carries a first gear wheel 23, fixed to the mounting plate 22 for example by screws, and which is intended to be driven by the first motor means 5.

The second pinion 20 is secured to a shaft 21 which is pivotally mounted relative to the fork 9 of the mount 3. This shaft 21 is coaxial with the bearing axis 7*a* or 7*b* and carries at its other end a second gear wheel 24 which is intended to be driven by the second motor means 6. The second gear wheel 24 is connected to the shaft 21 for example by an axial screw.

The detailed mounting of the shaft 21 on the fork 9 is not shown in FIG. 6. This shaft 21 must, as mentioned above, be free to rotate relative to the fork 9. It must also be immobilized in translation relative to the fork 9. This connection is ensured, for example, by spring washers (not shown).

Thus, as can be seen in FIGS. 5 and 6, the mount 3 includes two coaxial gear wheels at its lower part. The first gear wheel 23 allows the fork 9 to be rotated around the bearing pointing axis 7*a* or 7*b*. The second gear wheel 24 allows the sleeve 8 (and therefore the tube 2) to be pivoted around the elevation pointing axis 14 (14*a* or 14*b*).

Figure 3:
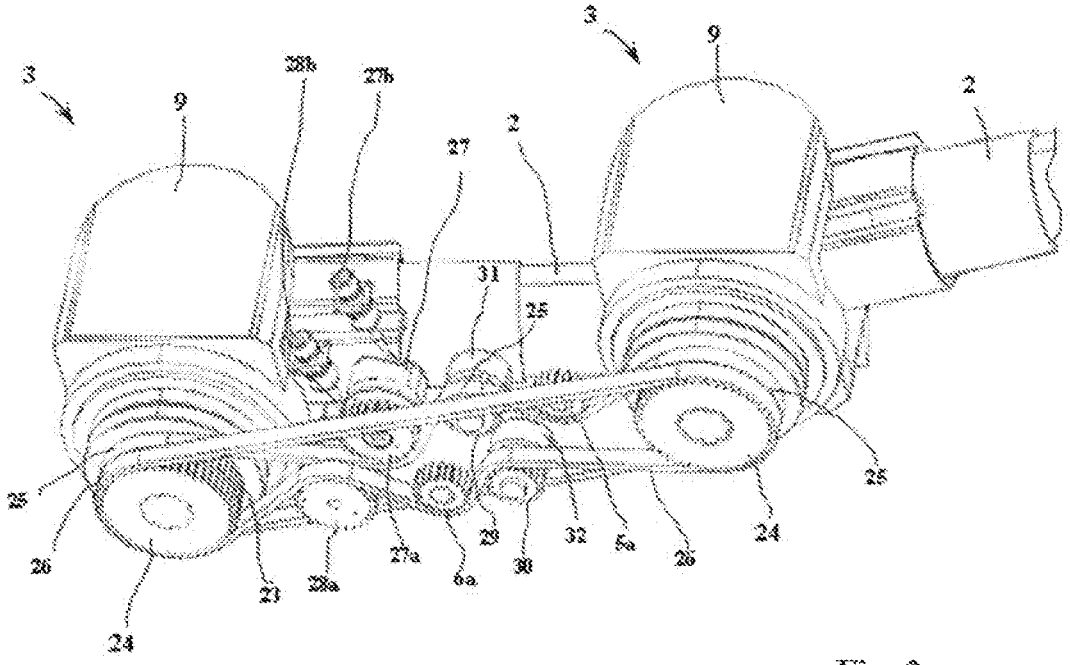
FIG. 3 is a bottom view with the base removed, showing the drive means.
Figure 4:
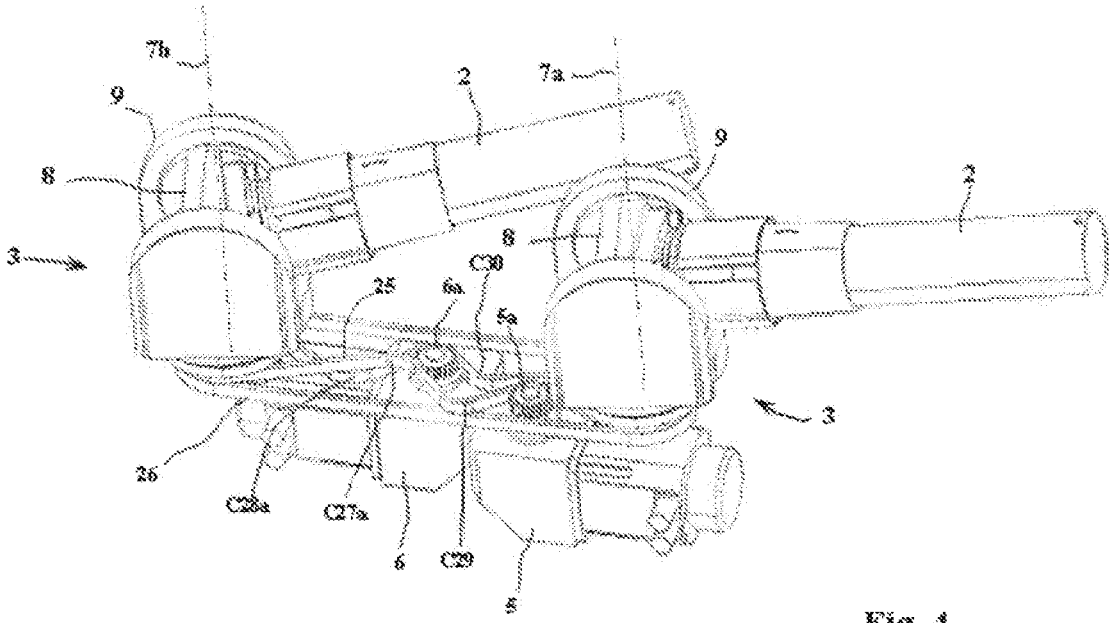
FIG. 4 is a top view with the base removed, showing the motor means and the drive means.

Referring to FIGS. 3 and 4, it can be seen that the first motor means 5 (FIG. 4) acts on the first gear wheels 23 of the mounts 3 in a simultaneous way by a first drive means 25 which comprises a first toothed belt 25.

At the same time, the second motor means 6 acts on the second gear wheels 24 of the mounts 3 in a simultaneous way by a second drive means 26 which comprises a second toothed belt 26.

The motor means 5 and 6 are visible in FIG. 4 but have been removed in FIG. 3 to better visualize the different elements that mesh on the toothed belts 25 and 26.

As can be seen in FIG. 3, each toothed belt 25 or 26 also meshes with an incremental encoder 27 or 28 through a specific pinion 27*a* or 28*a*. The encoders are also visible in FIGS. 1 and 2 as well as their connectors 27*b* and 28*b*.

The incremental encoders 27 and 28 are connected, by their connectors 27*b* and 28*b* and wire links not shown, to the electronic control box of the first and second motor means. They allow, in a conventional way, to realize the servocontrol of the pointing in elevation or bearing by supplying the information regarding the pivoting carried out by each motor means.

It can also be seen on FIG. 3 that each toothed belt 25 or 26 also meshes with a pinion 29 or 30 which is connected to a square operating nut (31 or 32 respectively), which is arranged on the outer face of the base 4 (see FIG. 2).

The square operating nuts 31 and 32 form emergency control means, which are secured to the base 4, and which make it possible to manually drive one or other of the toothed belts 25 or 26. In this way, in the event of failure of one and/or the other motor means, it is possible to manually point the mounts 3 in a medium direction ensuring a desired level of protection.

As seen in FIGS. 3 and 4, the pinion 5*a* connecting the first motor means 5 to the first toothed belt 25 is located outside the first toothed belt 25 and the same is true for the pinion 27*a* of the encoder 27, while the pinion 29 of the emergency control means as well as the first toothed wheel 23 are located inside the first toothed belt 25. The first toothed belt 25 is thus toothed on both sides. Such belts are commercially available.

In a similar manner, the pinion 6*a* connecting the second motor means 6 to the second toothed belt 26 is located inside the second toothed belt 26 and the same is true for the second gear wheel 24, while the pinion 30 of the emergency driving means as well as the pinion 28*a* of the encoder 28 are located outside the second toothed belt 26. The second toothed belt 26 is therefore also toothed on both sides.

FIG. 3 shows the pinions 5*a* and 6*a* connecting the belts to the motor means 5 and 6.

It should be noted that on FIG. 4, due to the absence of representation of the pinions 27*a*, 28*a*, 29 and 30, curvature of the belts 25 and 26 make it possible to locate the position of the pinions 28*a* and 30 (marks C28*a* and C30) for the belt 26 and of the pinions 27*a* and 29 for the belt 25 (marks C27*a* and C29).

It can be seen that the configuration proposed by the invention makes it possible to realize particularly compact launching devices. All the control means can be housed in the base 4, which has a moderate thickness due to the axial superposition of the two toothed belts 25 and 26.

It should be noted that it is possible, by using longer belts, to create devices with more than two mounts 3.

The tension of the belts 25 and 26 can be adjusted, for example, by providing the possibility of moving the pinions 29 and 30 of the emergency control means transversely with respect to the base 4.

As an alternative, it would also be possible to replace the drive of the gear wheels 23 and 24 of the two mounts 3 by toothed belts, with sliding racks (guided in translation).

A first rack would then engage both the pinion 5*a* of the first motor means 5 and the first gear wheels 23 of both mounts 3. A second rack would engage both the pinion 6*a* of the second motor means 6 and the second gear wheels 24 of both mounts 3.

Emergency control means could be provided on each rack as well as, of course, incremental encoders.

However, this rack-based solution would be more cumbersome axially, as the racks would have to be long enough to cover all the desired pointing amplitudes.

Figure 7:
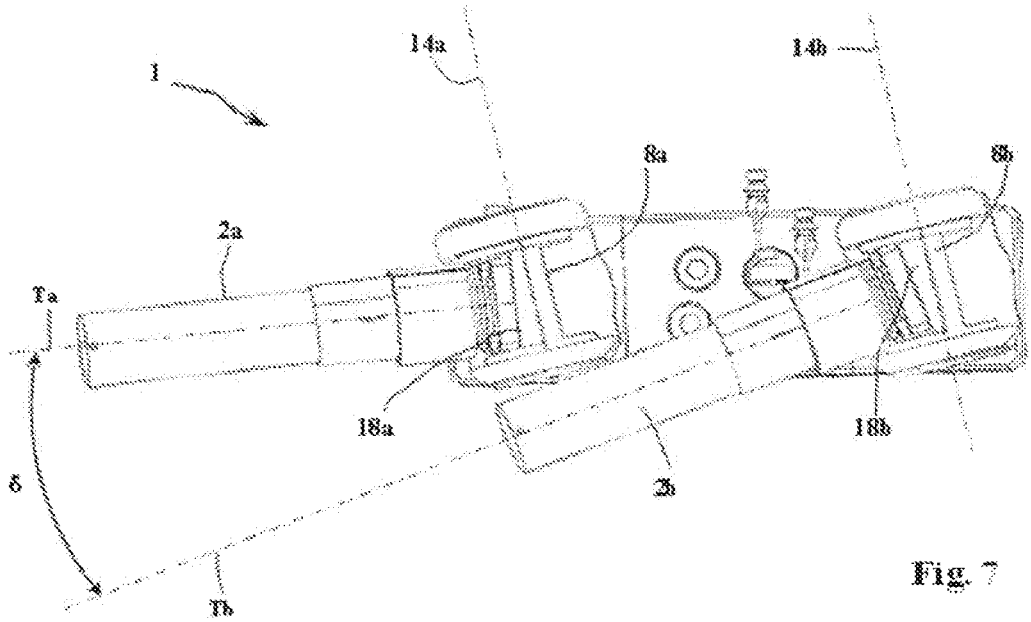
FIG. 7 is a top view of one alternative embodiment of the invention incorporating wedges, showing the offset of the axes of the tubes.

It can be seen from the figures that the T axes of each tube 2 are offset in bearing by a fixed angle δ (see also FIG. 7). Such an arrangement allows the area of effectiveness of the launching device 1 to be widened. The angle of offset δ can be between 10° and 20° (15° in the figures). This angle corresponds to what is measured when the two tubes 2 have zero elevation.

Such an offset can be obtained by giving by design an angular offset (here of 15°) between the elevation pointing axes 14 of each mount 3. Such a solution has the disadvantage that, as the elevation pointing angle increases, the axes Ta, Tb of the tubes 2*a* and 2*b* move closer together and an overlapping of the areas of effectiveness of the ammunition that are fired.

In order to maintain the offset in bearing δ constant, whatever the elevation angle, it is necessary that the elevation pointing axes 14 are parallel. The offset in bearing between the axes of the tubes 2 is then achieved by the installation of a wedge 18, interposed between the tube 2 and the sleeve 8.

FIGS. 7 and 8 show this particular embodiment. It can thus be seen in FIG. 7 that the elevation pointing axes 14*a* and 14*b* are indeed parallel but that each tube 2*a*, 2*b* forms an angle with its elevation pointing axis 14*a* or 14*b* which is not equal to 90°.

Thus, in FIG. 7, the angle between the axis Ta of the front tube 2*a* and the elevation pointing axis 14*a* is less than 90°. It is equal to 90°−7.5°=82.5°, the angle of the wedge 18*a* being 7.5°.

Conversely, the angle between the axis Tb of the rear tube 2*b* and the elevation pointing axis 14*b* is greater than 90°. It is equal to 90°+7.5°=97.5°, the angle of the wedge 18*b* being again 7.5°, but the wedge 18*b* being positioned in the opposite direction to the previous one.

The result is a bearing offset δ of the tubes 2*a* and 2*b* which is equal to 15°, and this offset remains the same whatever the elevation pointing, the axes 14*a* and 14*b* being parallel.

It can thus be seen that one and the same shape of wedge 18 makes it possible to obtain the desired offset with a balanced distribution of the firing forces between the two mounts 3.

The launching device according to the invention is therefore particularly compact, which facilitates its integration on any type of platform, fixed or mobile, in particular on armored vehicles.

FIGS. 9*a* and 9*b* show an example of integration of four devices 1 according to the invention on a light armored vehicle 33.

In this integration example, the devices 1 are fixed to the roof 34 of the vehicle 33, at the four corners of the roof. It can be seen that the devices 1*c* and 1*d* which are attached at the rear have their tubes pre-oriented in bearing with angles α1 and α2 of their axes relative to the direction of advance Δ of the vehicle which are greater than the angles β1 and β2 made by the axes of the tubes of the devices 1*a* and 1*b* attached at the front of the vehicle.

It is easy with one single definition of the device 1 to give the tubes a pre-orientation angle in this way. It is enough to program the control system of the device giving the desired orientation as default orientation (modification or "offset" of the origin of the pointings).

It is noted that for each device there is always an offset in bearing between the two tubes (here about 15°). This offset δ is fixed by the wedges 18 described previously.

It is similarly possible to set a default elevation angle for each device.

The device according to the invention can therefore also be fixed to an inclined wall. In this case, preset elevations and bearings will be chosen to obtain the desired distribution for the firing of ammunition.

The invention claimed is:

1. A launching device comprising:

at least two tubes intended to receive an ammunition round, each tube secured to a respective mount, the mounts being carried by a base, each tube being orientable in elevation and in bearing by motor means, wherein the motor means comprises:

a first motor means ensuring a pointing in bearing of the tubes, around bearing pointing axes, simultaneously and a second motor means ensuring a pointing in elevation of the tubes, around elevation pointing axes, simultaneously, wherein the bearing pointing axes of the tubes are parallel to each other and each mount includes a sleeve carrying the respective tube, said sleeve being mounted so as to pivot in elevation relative to a respective fork, the fork being mounted so as to pivot in bearing relative to the base, the second motor means acting on each sleeve via a set of two bevel toothed pinions with perpendicular axes integrated into the respective mount, wherein each set of two bevel toothed pinions includes a first pinion secured to the sleeve and a second pinion coaxial with the bearing pointing axis, the first motor means acting on each mount via a first gear wheel secured to the respective fork, and each second bevel pinion being secured to one end of a respective pivot shaft carrying at another end a second gear wheel driven by the second motor means, each pivot shaft being coaxial with the respective first gear wheel.

2. The launching device according to claim 1, wherein the first motor means acts on the first gear wheels of the mounts in a simultaneous way by a first driving means which comprises a first toothed belt.

3. The launching device according to claim 2, wherein the second motor means acts on the second gear wheels of the mounts in a simultaneous way by a second driving means which comprises a second toothed belt.

4. The launching device according to claim 3, wherein at least one emergency control means is secured to the base and allows to drive one or other of the first and second toothed belts manually.

5. The launching device according to claim 2, wherein at least one emergency control means is secured to the base and allows to drive the first toothed belt manually.

6. The launching device according to claim 1, wherein the second motor means acts on the second gear wheels of the mounts in a simultaneous way by a second driving means which comprises a second toothed belt.

7. The launching device according to claim 6, wherein at least one emergency control means is secured to the base and allows to drive the second toothed belt manually.

8. The launching device according to claim 1, wherein each tube has a longitudinal axis and the longitudinal axes of the tubes are offset in bearing by a fixed offset angle.

9. The launching device according to claim 8, wherein the axes of pivoting in elevation of the tubes are parallel, the offset between the longitudinal axes of the tubes being ensured by at least one wedge interposed between a tube and the respective sleeve.

10. The launching device according to claim 9, wherein a wedge is interposed between each tube and the associated sleeve, the offset angle between the tubes resulting from the combination of the inclinations given by each wedge.

11. The launching device according to claim 10, wherein the offset angle is between 10° and 20°.

12. The launching device according to claim 9, wherein the offset angle is between 10° and 20°.

* * * * *